US007459623B2

(12) United States Patent
Robertson

(10) Patent No.: US 7,459,623 B2
(45) Date of Patent: Dec. 2, 2008

(54) SOUND RESPONSIVE LIGHT SYSTEM

(76) Inventor: Bruce E. Robertson, 12030 Washington Blvd., #200, West Los Angeles, CA (US) 90066

( * ) Notice: Subject to any disclaimer, the term of this patent is extended or adjusted under 35 U.S.C. 154(b) by 0 days.

(21) Appl. No.: 11/371,693

(22) Filed: Mar. 9, 2006

(65) Prior Publication Data

US 2007/0209497 A1 Sep. 13, 2007

(51) Int. Cl.
*A63J 5/10* (2006.01)

(52) U.S. Cl. ..... 84/464 R; 84/464 A; 340/815.46

(58) Field of Classification Search ..... 84/815 R, 84/464 A; 340/815.46
See application file for complete search history.

(56) References Cited

U.S. PATENT DOCUMENTS

| | | | | |
|---|---|---|---|---|
| 4,185,276 | A | 1/1980 | Benson | |
| 4,262,338 | A | 4/1981 | Gaudio, Jr. | |
| 4,264,845 | A | 4/1981 | Bednarz | |
| 4,265,159 | A | 5/1981 | Liebman et al. | |
| 4,355,348 | A | 10/1982 | Williams | |
| 4,394,656 | A * | 7/1983 | Goettsche | 340/825.73 |
| 4,440,059 | A | 4/1984 | Hunter | |
| 4,768,086 | A | 8/1988 | Paist | |
| 4,809,584 | A | 3/1989 | Forrest | |
| 4,928,568 | A | 5/1990 | Snavely | |
| 5,083,064 | A | 1/1992 | Jones, Sr. | |
| 5,174,649 | A | 12/1992 | Alston | |
| 5,191,319 | A * | 3/1993 | Kiltz | 345/73 |
| 5,206,629 | A | 4/1993 | DeMond et al. | |
| 5,365,149 | A * | 11/1994 | Blakeslee et al. | 315/200 A |
| 5,365,939 | A | 11/1994 | Ochs | |
| 5,936,599 | A | 8/1999 | Reymond | |
| 6,046,724 | A * | 4/2000 | Hvass | 345/600 |
| 6,841,724 | B2 * | 1/2005 | George | 84/477 R |
| 6,930,235 | B2 * | 8/2005 | Sandborn et al. | 84/483.2 |
| 2002/0154787 | A1 * | 10/2002 | Rice et al. | 381/124 |
| 2005/0213343 | A1 * | 9/2005 | Jablonski | 362/602 |
| 2006/0197673 | A1 * | 9/2006 | Atris et al. | 340/815.46 |

OTHER PUBLICATIONS

Office Action mailed on May 22, 1992 in U.S. Appl. No. 07/737,267.
PCT International Search Report and Written Opinion dated Mar. 5, 2008; Application No. PCT/US07/04806, filing date Feb. 23, 2007.

* cited by examiner

*Primary Examiner*—Renee S Luebke
*Assistant Examiner*—Vanessa Girardi
(74) *Attorney, Agent, or Firm*—Knobbe, Martens, Olson & Bear LLP

(57) ABSTRACT

In one embodiment, the present invention comprises a sound responsive light system. The system comprises an amplifier configured to receive an input signal from an audio source. The input signal corresponds to an audio signal. The system further comprises a plurality of filters configured to receive an amplified signal from the amplifier. A selected filter filters out signals outside of a selected frequency range. The system further comprises a group of light sources associated with the selected filter. The system further comprises a driver coupled to the group of light sources and configured to regulate a current and/or a voltage supplied to a selected light source. The current and/or voltage supplied to the selected light source depends at least partially on an amplitude of signals within the selected frequency range. The group of light sources are positioned in a spiral. The group of light sources are associated with multiple colors.

11 Claims, 3 Drawing Sheets

SOUND RESPONSIVE LIGHT SYSTEM

FIELD OF THE INVENTION

The present invention relates generally to lighting systems, and relates more particularly to sound-responsive entertainment lighting systems.

BACKGROUND OF THE INVENTION

Lighting and sound are often used to compliment each other and to enhance the combined effects of each other for entertainment purposes. Systems that make this combination typically operate by taking input information from music, and generating visual patterns that correspond to the music in some way. Such systems are often used to augment musical entertainment at concerts, nightclubs, and the like, but also are also commonly used to provide a visual dimension to audible musical entertainment when the music is prerecorded or when no other visual entertainment is provided.

Recent developments in the electronics field have made it possible to combine light and music in new ways. For instance, systems in which a plurality of lights are selectively lit in response to differences in the volume or the frequency of music have been developed. As one example, many frequency analyzers include graphic equalizers that have a "bar graph"-type display with selected frequency ranges provided along a horizontal axis, and a vertical axis that corresponds to the volume of the selected frequency ranges. Such systems are useful for providing information about the volume at which a particular frequency range is provided.

Disadvantageously, many conventional systems are unattractive when not lit. Further, even when lit, many conventional systems are overly technical in appearance, and more suited to a dance club than in a personal residence, such as a home.

BRIEF SUMMARY OF THE INVENTION

In one embodiment, a sound responsive light system comprises an amplifier configured to receive an input signal from an audio source. The input signal corresponds to an audio signal. The system further comprises a plurality of filters configured to receive an amplified signal from the amplifier. A selected filter filters out signals outside of a selected frequency range. The system further comprises a group of light sources associated with the selected filter. The system further comprises a driver coupled to the group of light sources and configured to regulate a current and/or a voltage supplied to a selected light source. The current and/or voltage supplied to the selected light source depends at least partially on an amplitude of signals within the selected frequency range. The group of light sources are positioned in a spiral. The group of light sources are associated with multiple colors.

In another embodiment, a light system that responds to audio signals comprises a frequency analyzer configured to separate an audio signal into a plurality of frequency bands. A selected frequency band includes selected components of the audio signal corresponding to a selected range of frequencies. The system further comprises a group of light sources associated with the selected frequency band. The group of light sources is positioned in a spiral, and is associated with multiple colors. The system further comprises a driver associated with the group of light sources. The driver is configured to selectively illuminate a quantity of the light sources. The quantity of illuminated light sources at least partially depends on an amplitude of the selected components of the audio signal.

In another embodiment, a method of operating a sound responsive light display comprises amplifying an audio signal received from an audio source to generate an amplified audio signal. The method further comprises passing the amplified audio signal through a filter, such that the filter filters out signals outside of a selected frequency band. The method further comprises illuminating a quantity of light sources from a group of light sources associated with the selected frequency band. The quantity of light sources illuminated depends on an audio signal amplitude associated with the selected frequency band. The group of light sources are positioned in a spiral, and wherein the group of light sources are associated with multiple colors.

In another embodiment, a method of operating a sound responsive light display comprises filtering a first selected frequency band from a digital audio signal. The method further comprises filtering a second selected frequency band from the digital audio signal. The method further comprises illuminating a first quantity of light sources from a first group of light sources associated with the first selected frequency band. The first quantity of light sources illuminated depends on an amplitude associated with the first selected frequency band. The first group of light sources are positioned in a spiral and are associated with a first color. The method further comprises illuminating a second quantity of light sources from a second group of light sources associated with the second selected frequency band. The second quantity of light sources illuminated depends on an amplitude associated with the second selected frequency band. The second group of light sources are positioned in a spiral and are associated with a second color that is different from the first color.

BRIEF DESCRIPTION OF THE DRAWINGS

Exemplary embodiments of the sound responsive light system disclosed herein are illustrated in the accompanying drawings, which are for illustrative purposes only. The drawings comprise the following figures, in which like numerals indicate like parts.

DETAILED DESCRIPTION OF THE INVENTION

The present invention relates to sound-responsive lighting systems. As will be described in greater detail below, an optional example embodiment combines a programmable sound responsive lighting circuit with an attractive artwork and a light baffle system to provide a sound-responsive lighting system that is suitable for the home and other locations and that can be used for contemplation and meditation.

In certain example embodiments, lights are positioned along one or more curved paths (for example, concentric circles, nested curves, one or more spirals, and the like) behind one or more color panels. Coupled to the rear of the panel is one or more opaque light baffles that optically prevent light emitted from lights along a first path from bleeding into a second path. In certain optional embodiments, a user can program light brightness, and light attack and/or decay times.

Figure 1:
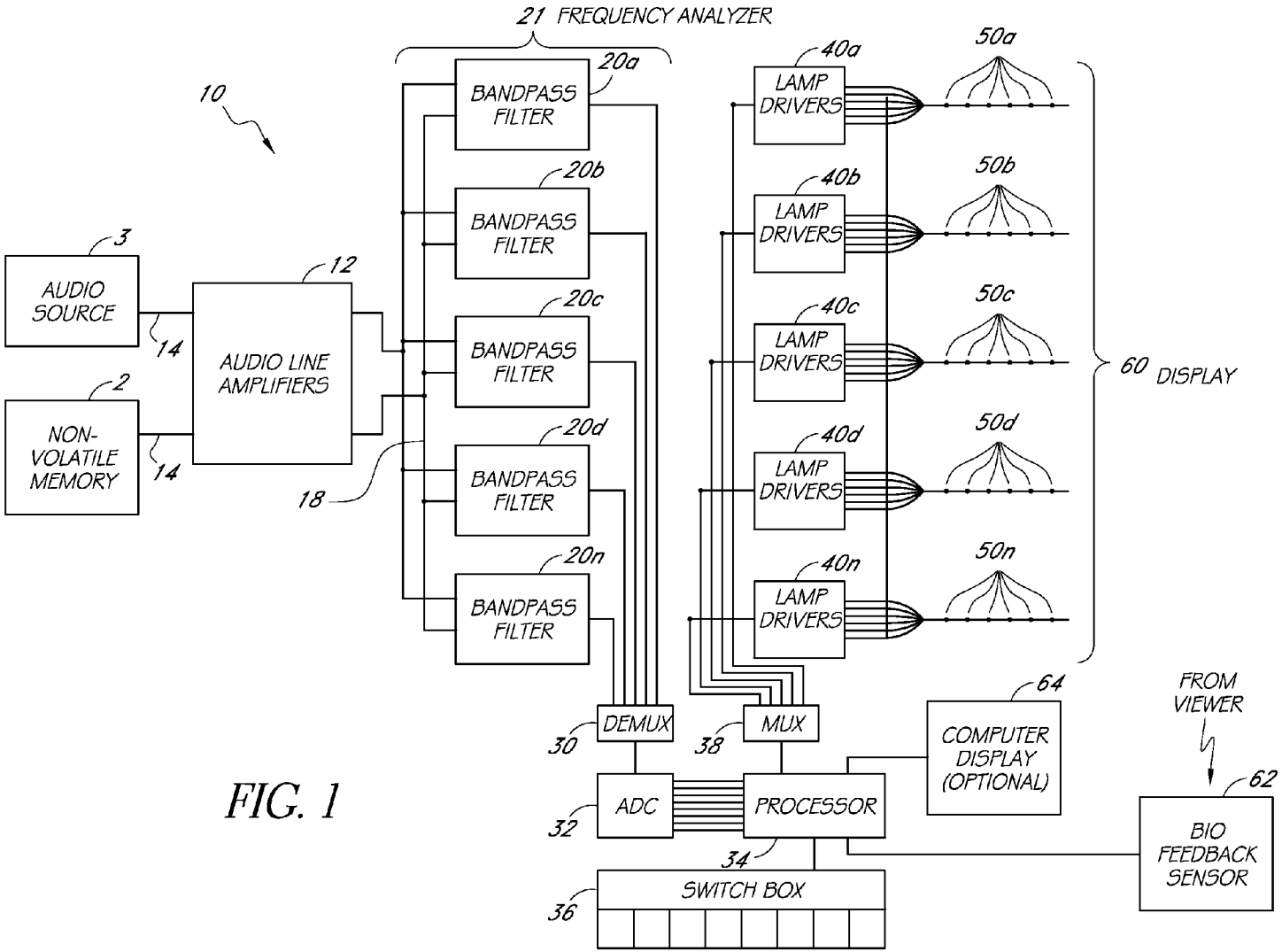
FIG. 1 is a schematic representation of selected components of an example sound responsive lighting system.

FIG. 1 schematically illustrates selected components of an example sound responsive lighting system 10. The sound responsive lighting system 10 includes an amplifier 12 configured to receive and amplify one or more audio signals from an audio source 3, such as a microphone, a radio, a computer, a compact disc player, a television, a mobile telephone, a tape deck, an MP3 player, and/or a digital video disk player. Other audio sources are used in other embodiments. The audio signals can be received by the sound responsive lighting system 10 as analog and/or digital signals.

The audio signals can be directly coupled to the sound responsive lighting system 10 from the audio source by cables or by a wireless interface (for example, Bluetooth), or via a wired or wireless network (for example, Ethernet or a wireless local network, such as IEEE 802.11 or 802.16). In other embodiments, an audio source is integrated into the sound responsive lighting system 10, such as by including a non-volatile storage memory 2 (e.g., Flash memory, hard disk drive, etc.) capable of storing audio programs, such as MP3, AVI, WAV, WMA files or other digitized sound recordings. In such embodiments, the system is capable of downloading audio programs from an external source, such as the Internet, via a network interface, or from another computer network, a computer, or another electronic memory device to the storage memory. Optionally, a user can define one or more play lists that include one or more audio programs/songs. For example, a user can name a play list as "mellow" and associate one or more mellow songs with the play list. One or more controls can be provided to select the sound recording/play list which is to be played. Optionally, a display is provided via which a user can view the available audio programs stored therein, and/or one or more play lists. Optionally, a fast forward, rewind, play, record, and/or pause controls are provides as well. Optionally, an embodiment can include both audio in ports in addition to nonvolatile memory for storing audio pieces on the system 10. Optionally, the system 10 includes one or more speakers for audio playback and a microphone for audio recording, wherein the audio recordings are stored in the non-volatile memory.

As illustrated, in certain embodiments the amplifier is configured to receive and amplify multiple-channel audio signals, such as stereo audio signals or other multiple-channel sound signals, through a plurality of input ports 14.

The amplified audio signals are passed through conductors 18 to n band pass filters 20*a*, 20*b*, 20*c*, 20*d* . . . 20*n*. The band pass filters are configured to pass those signal components within a selected frequency band, and to substantially filter out signal frequency components outside the selected frequency band. In an example embodiment, each of the plurality of band pass filters 20*n* is configured to pass signals within a unique frequency band. Although only five band pass filters are illustrated in FIG. 1, more or fewer band pass filters are used in other embodiments. In certain embodiments, between 10 and 30 band pass filters are used, and in an example embodiment, 16 band pass filters are used. In general, a sound responsive lighting system having n band pass filters will produce n filtered audio signals. In an example embodiment, the n band pass filters constitute a frequency analyzer 21.

If the audio signals are received digitally, the band pass filtering can be performed digitally using a digital signal processor ("DSP") and optionally are not amplified via audio line amplifiers 12. Thus, in an example embodiment, the audio line amplifiers 12 are not used.

If the audio signals are in analog form, the filtered audio signals are passed through a demultiplexer 30 and an analog-to-digital converter 32 (which converts the analog audio signals to digital form) to a processor 34. If the audio signals are in digital form already, the analog-to-digital converter 32 is not included. The processor 34, which is at least partially controlled by a switch box 36, is configured to generate a plurality of lamp drive signals based at least partially on the filtered audio signals. Generally, a processor for a sound responsive lighting system having n band pass filters is configured to produce n lamp drive signals, although fewer or more lamp drive signals can be generated. In one embodiment, the processor 34 produces a lamp drive signal having a magnitude that is directly proportional to an amplitude of the corresponding filtered audio signal. In another embodiment, lamp drive signal magnitude is related to, but is not directly proportional to an amplitude of the corresponding filtered audio signal.

The lamp drive signals are passed through a multiplexer 38 to a plurality of lamp drivers 40*a*, 40*b*, 40*c*, 40*d* . . . 40*n*. In an example embodiment, each of the lamp drivers 40*n* is configured to regulate a current and/or voltage supplied to a group of display lamps 50*a*, 50*b*, 50*c*, 50*d* . . . 50*n*, which are illustrated schematically in FIG. 1. In other embodiments, the lamp drivers 40*n* are configured to regulate other characteristics of the signals provided to the display lamps 50*n*, such as pulse width, energy, and duty cycle.

In one embodiment, the lamp drivers 40*n* are configured to illuminate a selected number of display lamps 50*n* based on the magnitude of the associated lamp drive signal. For example, in such embodiments the high-amplitude lamp drive signal causes all m display lamps in the group of display lamps 50*n* to be illuminated, whereas a lower-amplitude lamp drive signal causes zero or only a portion of the m display lamps in the group of display lamps 50*n* to be illuminated. The display lamps are sometimes also referred to as "light sources" (e.g., see light source 72 illustrated in FIGS. 2B, 3B), and are selected from a variety of different elements capable of generating light, such as incandescent lights, light emitting diodes, laser diodes, and other light generating elements. In one embodiment, the group of display lamps 50*n* includes more than one type of light source. In certain embodiments, the group of display lamps 50*n* includes light sources having different properties, such as different colors, different attack rates, and/or different decay rates.

In an example embodiment, a sound responsive lighting system having n band pass filters includes a processor that is configured to produce n lamp drive signals, wherein each of the n lamp drive signals corresponds to one of the n filtered frequency bands of the audio signal received from the audio source. In such example embodiments, the sound responsive lighting system includes n lamp drivers, such that each of the n lamp drivers corresponds to one of the n filtered frequency bands. Furthermore, as illustrated in FIG. 1, each of the n lamp drivers is coupled to m display lamps, such that each of the n frequency band corresponds to m display lamps. In this example, the sound responsive lighting system includes n×m individual display lamps.

Figure 2:
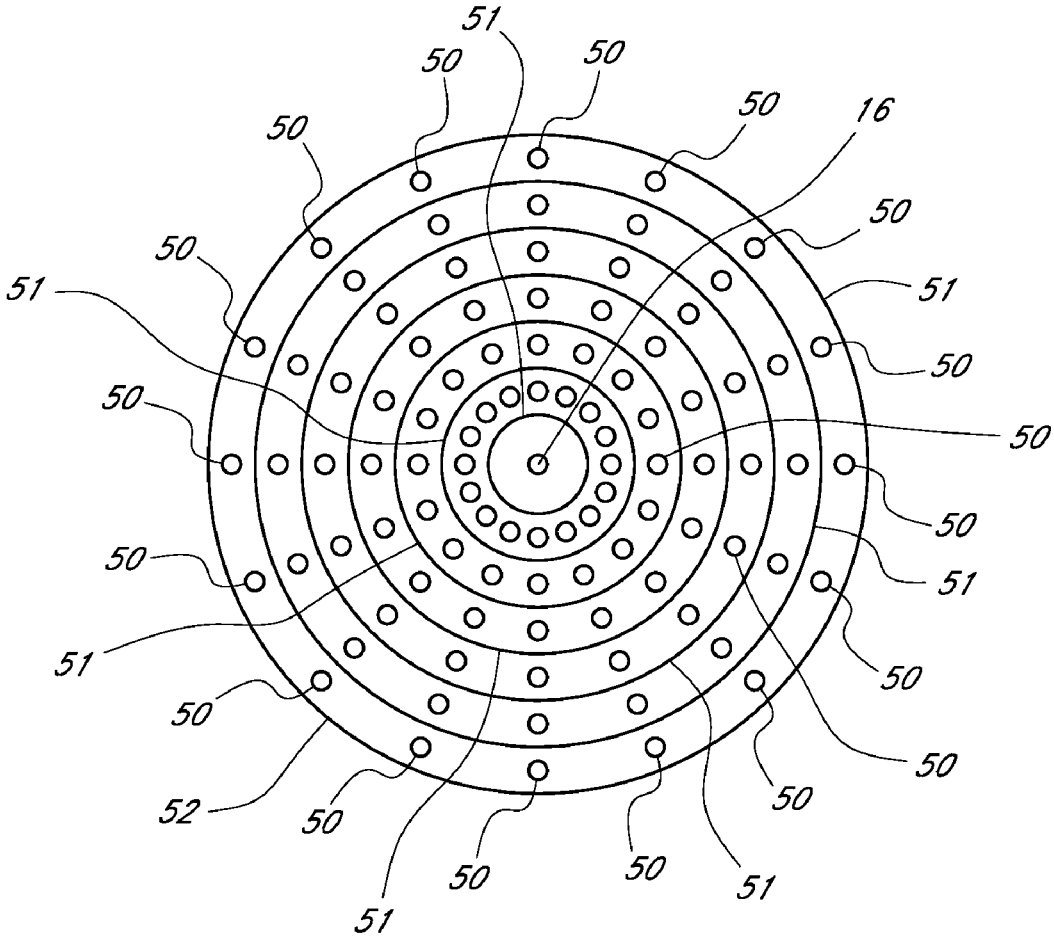
FIGS. 2 and 2B respectively illustrate a front view of an example light array for use with the sound responsive lighting system of FIG. 1, and a side view thereof.

FIG. 2 illustrates an example light array 52 for use with the sound responsive lighting system 10. In the light array 52, the plurality of display lamps 50*n* are arranged in a plurality of concentric circles 51 around a center lamp 16. In an example embodiment, each concentric circle 51 includes one display lamp from each of the n groups of display lamps; in this embodiment the light array 52 includes m concentric circles, each having n display lamps. In such embodiments, the m display lamps in a selected group of display lamps can be positioned in a straight light configuration, or can be positioned in a spiral configuration. In an example embodiment wherein each of the n groups of m display lamps are positioned in a spiral configuration, the sequence of colors of display lamps spiraling from the center of the light array is identical for each of the n groups of m display lamps.

In an alternative embodiment, the light array 52 includes n concentric circles, wherein each concentric circle 51 includes the m display lamps in a selected group of display lamps 50*n*. Other groupings of display lamps within the concentric circles are used in other embodiments. The sequence and manner in which the display lamps are illuminated is controlled by the processor 34. As described herein, the sound responsive lighting system 10 optionally includes a center lamp 16 which is illuminated independently of the audio signals. In such embodiments, the center lamp is optionally used to provide ambient lighting. In modified embodiments, additional ambient lighting is provided by one or more additional audio-independent light sources positioned around the periphery of the light array 52.

Figure 2B:
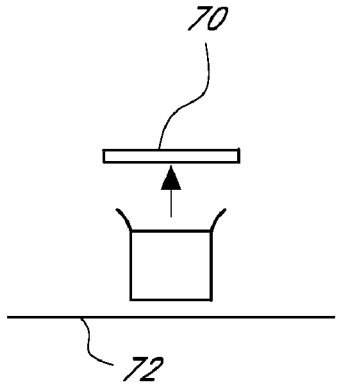

In certain embodiments, the display 60 lamps 50*n* include lamps of various colors, while in other embodiments the light array 52 optionally includes an overlying color filter 70 (see FIG. 2B). In an example embodiment, lamps of various colors and one or more color filters are used. In a modified embodiment, software for driving a "soft" version of the display (e.g., a multi-colored mandala, corresponding to, by way of example, that illustrated in FIG. 2) is stored on a terminal (e.g., a video game machine, a personal computer, a networked television, etc.). Rather than using discrete display lamps, this embodiment uses pixels of a computer display 64 (e.g., an LCD, plasma, CRT, field effect display, surface effect display, etc.) under software control to create the mandala, such that the sound responsive lighting system produces visual output on a computer or other terminal screen, which will optionally appear to be similar or identical to the system 10. For example, in certain embodiments the sound responsive lighting system is part of a software plug-in application used with a computer-based digital media player, such as one that manages and plays back audio recordings. Thus, in such embodiments a computer display 64 comprises a screen including a plurality of light sources or light valves (e.g., plasma display pixels or LCD display pixels), some of which are selectively illuminated by software executed by a processor to provide the visual effects described elsewhere herein.

By way of illustration, in one embodiment each concentric circle 51 includes display lamps of a common unique color. In another embodiment, each concentric circle 51 includes a plurality of display lamps, each having a unique color. In certain embodiments, the optional color filter has artwork printed thereon, such that illumination of the display lamps causes the artwork to become at least partially illuminated/backlit. In an example embodiment, the artwork has the appearance of a multi-colored mandala. The mandala can be suitable for contemplation and/or meditation. In embodiments wherein a translucent color filter is positioned over the light array 52, the display lamps 50*n* comprise white lights.

As described herein, the n lamp drivers 40*n* are associated with a group of display lamps 50*n*. In an example embodiment, the group of display lamps 50*n* corresponding to a particular lamp driver 40*n* are all of the same color. In an alternative embodiment, the group of display lamps 50*n* corresponding to a particular lamp driver 40*n* comprises a plurality of display lamps that each have a unique color. For example, in one such embodiment, each group of display lamps 50*n* includes a violet, blue, green, yellow, orange and red display lamp. As described herein, in certain embodiments the group of display lamps 50*n* is arrayed within a common concentric circle 51. In other embodiments, the group of display lamps 50*n* is arrayed radially, and optionally spirally, from the center lamp 16. As used herein, a "spiral" configuration is a configuration wherein the group of display lamps 50*n* are positioned at locations defined by polar planar coordinates $(\rho_1, \theta_1), (\rho_2, \theta_2) \ldots (\rho_n, \theta_n)$. In one embodiment, none of the values $\rho_1, \rho_2, \ldots \rho_n$ are equal. In an optional modification, none of the values $\theta_1, \theta_2, \ldots \theta_n$ are equal.

In certain embodiments, each lamp driver 40*n* corresponds to a selected frequency band, as filtered by one of the band pass filters 20*n*. In such embodiments each frequency band is optionally associated with a group of display lamps 50*n* having a specific color. This enables a configuration wherein, for example, low audio frequencies cause violet, blue or green display lamps to illuminate, and high audio frequencies cause red, orange or yellow display lamps to illuminate.

The switch box 36 is optionally used as a user interface for controlling and providing instructions to the processor 34. For example, the switch box 36 optionally is used to perform one or more of the following:

adjust the attack rate and/or the decay rate of the display lamps 50*n;* illuminate a user-defined pattern of display lamps 50*n* in the light array 52;

illuminate all of the display lamps 50*n* in the light array, regardless of the audio signals, which is usable to provide ambient light or to fully illuminate an artwork overlying the light array 52;

selectively illuminate display lamps 50*n* having a common color;

provide timed switching from display lamps of a first selected color to display lamps of a second selected color;

illuminate the display lamps 50*n* in a spiral pattern;

selectively illuminate the center lamp 16;

sequentially illuminate all of the display lamps in the concentric circles 51, either from the center outward or from the outer concentric circle to the center;

adjust the quantity of light sources illuminated from a given amplitude of the audio signal; and randomly illuminate the display lamps 50*n*.

The switch box 36 is optionally used to create still other visual effects. In an example embodiment, the switch box 36 is a physical control unit having dedicated controls, such as buttons, switches and/or other user-operable controls. The switch box 36 is optionally capable of being remote-controlled, such as through the use of a wired network interface or a wireless transmitter and receiver. The switch box 36 is also optionally capable of generating visual effects based on a visual display program stored in nonvolatile storage memory that forms a part of the sound responsive lighting system. For example, the visual display program is transferred to the sound responsive lighting system form an external source, such as the Internet or another computer network, a computer, or another electronic memory device. In certain embodiments, the switch box comprises a computer having a user interface that is capable of providing instructions to the processor 34.

In a modified embodiment, the sound responsive lighting system includes one or more biofeedback sensors 62 that are configured to be attached to a person viewing or otherwise experiencing the system. Signals collected using the biofeedback sensors 62 are used to selectively illuminate and/or control the intensity and/or color of the display lamps 50*n* (or display pixels if connected to a computer hosting the display software as described above), in similar fashion to the way that the audio signals are used to selectively illuminate the display lamps 50*n*. Example biofeedback sensors include temperature sensors, pulse rate sensors, sweat or moisture sensors, brain activity sensors and motion sensors. For example, in one embodiments a decrease in pulse rate results in the display lamps 50*n* flashing and/or illuminating at a slower rate. By way of further example, a relatively low temperature reading may result in relatively less illumination and/or relatively more illumination of blue lamps and relatively less illumination of red lamps. Optionally, a combination of biofeedback sensor readings and audio signals are used to control the system 10.

Figure 3:
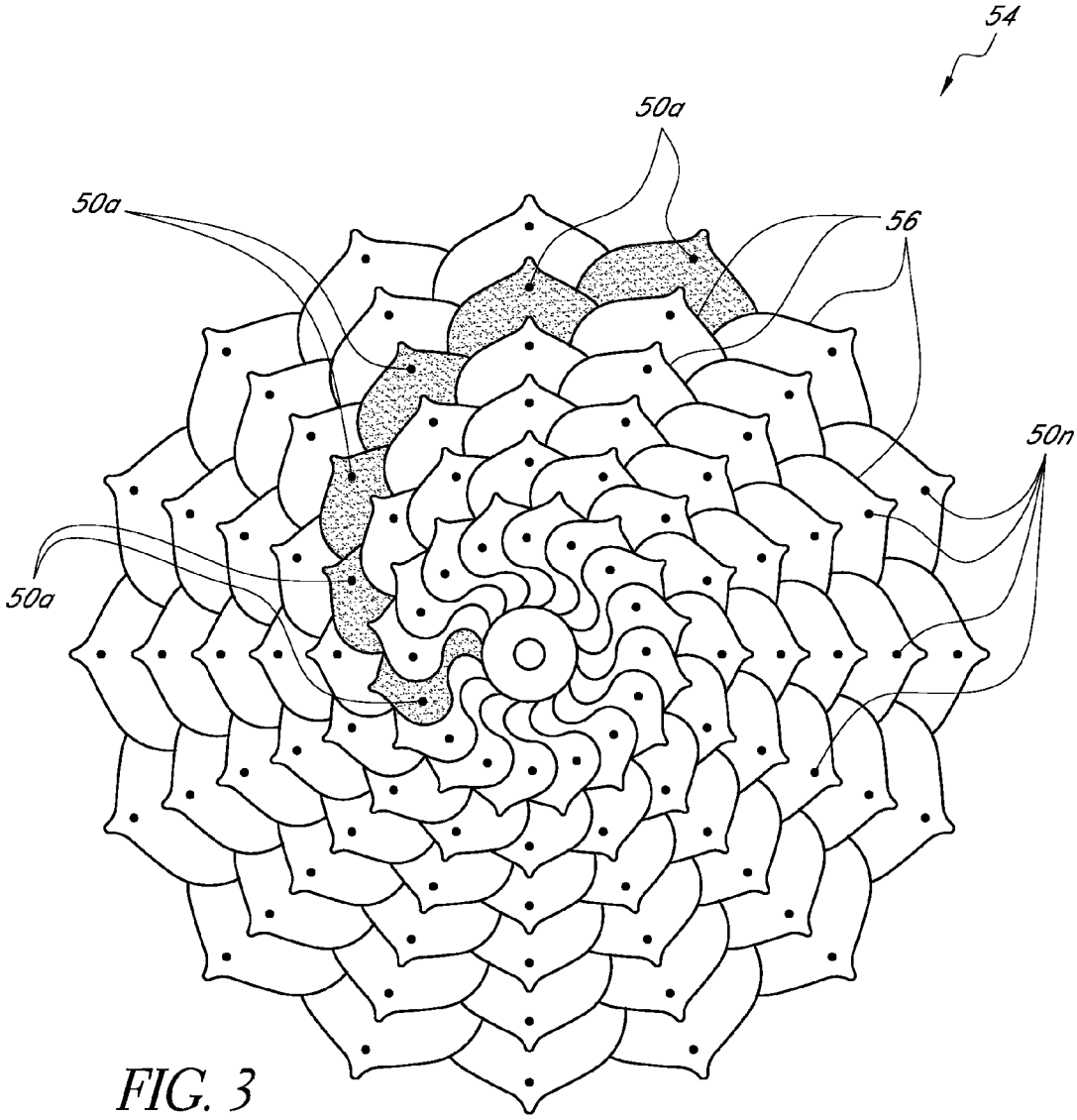
FIGS. 3 and 3B respectively illustrate a front view of an example baffled light array for use with the sound responsive lighting system of FIG. 1, and a side view thereof.
Figure 3B:
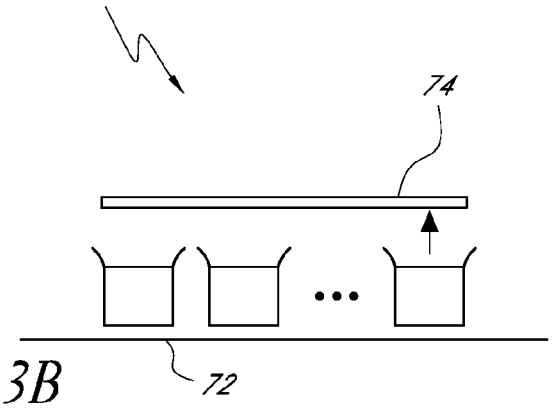

In an example embodiment, a baffle structure is positioned between at least some of the display lamps 50*n*, thereby allowing a selected display lamp to illuminate a selected region of the light array 52 without illuminating neighboring regions from behind. FIG. 3 is a front view of an example baffled light array 54 configured for use with the sound responsive lighting system 10 of FIG. 1. The baffled light array 54 includes a plurality of baffles 56 which surround the display lamps 50*n*. In a modified embodiment, the baffles are configured to surround a plurality of display lamps.

FIG. 3 also illustrates an example color distribution that is used in certain embodiments. Specifically, FIG. 3 illustrates a selected group of seven display lamps 50*a* that are arrayed in a spiral configuration, and that are associated with a common selected color. The seven display lamps 50*a* are positioned at locations defined by polar planar coordinates $(\rho_1, \theta_1)$, $(\rho_2, \theta_2) \ldots (\rho_7, \theta_7)$, wherein none of the values $\rho_1, \rho_2, \ldots \rho_7$ are equal, and none of the values $\theta_1, \theta_2, \ldots \theta_7$ are equal. In this example embodiment, other groups of display lamps, arrayed in similar spiral patterns, are associated with other colors. This configuration provides a plurality of spirals that extend from the center of the sound responsive lighting system 10, wherein each spiral is associated with a different color, and optionally, a different frequency band. In certain embodiments, this example color distribution is provided by arraying different-colored display lamps at appropriate positions in the baffled light array 54. In other embodiments, this example color distribution is provided through the use of an appropriately-colored translucent filter positioned over a baffled array of white display lamps.

As previously discussed, the translucent filter can include color artwork (see, e.g., translucent artwork 74 illustrated in FIG. 3B) that, in combination with the activated lights and/or with the lights disabled, is suitable for contemplation and/or meditation. In the example illustrated in FIG. 3, the image is of a multicolored mandala. Optionally, the mandala can represent the cosmos (for example, metaphysically or symbolically). The mandala can include a plan, a chart, and/or a geometric pattern representing the cosmos/universe. The artwork (for example, the mandala) can be suitable for, and used during meditation, wherein the user focuses the user's attention on the artwork. The example mandala has symmetrical geometric shapes in the form of spiraling lotus leaves which tends draw the attention of the user toward the mandala, and particular, towards the mandala center, which is sometimes referred to as a seed.

The lights, illuminated as described herein in response to music, can further aid contemplation and meditation and can further help focus a user's attention on the mandala. The mandala colors are optionally selected to correspond to those of a conventional, non-illuminated mandala. For example the colors can include white, yellow, red, green, and blue, although other colors can be used as well.

SCOPE OF THE INVENTION

While the foregoing detailed description discloses several embodiments of the present invention, it should be understood that this disclosure is illustrative only and is not limiting of the present invention. It should be appreciated that the specific configurations and operations disclosed can differ from those described above, and that the methods described herein can be used in contexts other than sound responsive light systems.

I claim:

1. A sound responsive light system comprising:

an amplifier configured to receive an input signal from an audio source, wherein the input signal corresponds to an audio signal;

a plurality of filters configured to receive an amplified signal from the amplifier, wherein a selected filter filters out signals outside of a selected frequency range;

a group of light sources associated with the selected filter; and a driver coupled to the group of light sources and configured to regulate a current and/or a voltage supplied to a selected light source, wherein:

the current and/or voltage supplied to the selected light source depends at least partially on an amplitude of signals within the selected frequency range, the light sources in the group are positioned in a spiral, a baffle is positioned to optically isolate a first subset of the group of light sources associated with a first color from a second subset of the group of light sources associated with a second color; wherein, the first subset of the group of light sources associated with the first color includes multiple light sources at different angular positions, and the second subset of the group of light sources associated with the second color includes multiple light sources at different angular positions.

2. The system of claim 1, wherein the multiple colors are generated by at least a first color filter positioned over a first subgroup of light sources, and a second color filter positioned over a second subgroup of light sources, wherein the first subgroup of light sources is optically isolated from the second subgroup of light sources.

3. The system of claim 1, further comprising a user interface, wherein the user interface includes an override control for adjusting the current supplied to the light source.

4. The system of claim 1, wherein the group of light sources comprise incandescent lights.

5. The system of claim 1, wherein the group of light sources comprise light emitting diodes.

6. The system of claim 1, wherein the driver is configured to increase and/or decrease the current and/or the voltage supplied to the selected light source at a user-adjustable rate.

7. The system of claim 1, further comprising a multi-color translucent artwork positioned over the group of light sources.

8. The system of claim 1, further comprising a plurality of sound-independent light sources, a selected sound-independent light source having a driver configured to regulate a user-controlled current and/or voltage supplied to the selected sound-independent light source.

9. The system of claim 1, further comprising a sound-independent light source positioned at a central position of the spiral.

10. The system of claim 1, wherein the audio source is selected from the group comprising of a microphone, a radio, a computer, a compact disc player, a television, a mobile telephone, a tape deck, an MP3 player, a digital video disk player, a sound system, and a public announcement system line feed.

11. The system of claim 1, wherein: the group of light sources includes n light sources located at n different positions defined by polar planar coordinates (.rho..sub.1, .theta..sub.1), (.rho..sub.2, .theta..sub.2) . . . (.rho..sub.n, .theta..sub.n); none of the values .rho..sub.1, .rho..sub.2, . . . .rho..sub.n are equal; and none of the values .theta..sub.1, .theta..sub.2, . . . .theta..sub.n are equal.

* * * * *

UNITED STATES PATENT AND TRADEMARK OFFICE

CERTIFICATE OF CORRECTION

PATENT NO. : 7,459,623 B2
APPLICATION NO. : 11/371693
DATED : December 2, 2008
INVENTOR(S) : Bruce E. Robertson It is certified that error appears in the above-identified patent and that said Letters Patent is hereby corrected as shown below:

At Column 8, Line 60-62, In Claim 11, change "(.rho..sub.l, .theta..sub.l), (.rho..sub.2, .theta..sub.2) . . . (.rho..sub.n, .theta..sub.n);" to --($\rho_1$, $\theta_1$), ($\rho_2$, $\theta_2$) ... ($\rho_n$, $\theta_n$,);--.

At Column 8, Line 62-63, In Claim 11, change ".rho..sub.l, .rho..sub.2, . . . .rho..sub.n" to --$\rho_1$, $\rho_2$, . . . $\rho_n$--.

At Column 8, Line 64, In Claim 11, change ".theta..sub.l, .theta..sub.2, . . . .theta..sub.n" to --$\theta_1$, $\theta_2$, . . . $\theta_n$--.

Signed and Sealed this

Second Day of June, 2009

JOHN DOLL
*Acting Director of the United States Patent and Trademark Office*